US006369503B1

(12) United States Patent
Tuttle et al.

(10) Patent No.: US 6,369,503 B1
(45) Date of Patent: Apr. 9, 2002

(54) MERCURY CAPSULE FOR USE IN A FLUORESCENT LAMP

(75) Inventors: Billy W. Tuttle, Londonderry, NH (US); Michael D. Sweetland, Brunswick, ME (US); Mark W. Grossman, Belmont, MA (US); Peter A. Marcurelle, Peabody, MA (US); William J. Roche, Merrimac, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/493,510

(22) Filed: Jan. 28, 2000

(51) Int. Cl.[7] ..... H01J 1/62
(52) U.S. Cl. ..... 313/490; 313/550
(58) Field of Search ..... 313/490, 550, 313/566, 546, 571

(56) References Cited

U.S. PATENT DOCUMENTS

| | | | | |
|---|---|---|---|---|
| 4,288,715 A | * | 9/1981 | Overveld et al. | 313/174 |
| 4,754,193 A | | 6/1988 | Holmes et al. | 313/490 |
| 4,870,323 A | | 9/1989 | Parks, Jr. et al. | 313/546 |

* cited by examiner

*Primary Examiner*—Vip Patel
(74) *Attorney, Agent, or Firm*—Carlo S. Bessone

(57) ABSTRACT

A mercury capsule for use in a fluorescent lamp comprises a metal ribbon which is provided with a first portion having a depression formed in a surface thereof for receiving and containing mercury, and a second portion having a protrusion formed on a surface thereof. A bendable portion interconnects the first and second portions. The second portion is bendably movable to a position wherein the protrusion overlies the depression and is further movable to place the protrusion in sealing engagement with the depression to sealingly enclose mercury in the depression.

20 Claims, 3 Drawing Sheets

MERCURY CAPSULE FOR USE IN A FLUORESCENT LAMP

BACKGROUND OF THE INVENTION

1. Field of the Invention

The invention relates to fluorescent lamps which contain mercury, and is directed more particularly to the means by which mercury is introduced into such lamps.

2. Description of the Prior Art

Fluorescent lamps require a minimum quantity of mercury to reach rated life. If an insufficient amount of mercury is disposed in the lamp, the lamp will not provide full light output for its rated life. In fabrication of fluorescent lamps, a current method for dispensing (or "dosing") mercury into the lamp includes mechanically dispensing the mercury into the lamp via a passageway, known as an exhaust tube. This has several disadvantages. First, control of the quantity of mercury dispensed is accomplished by mechanical means which slice off a body of mercury which falls into the lamp via the exhaust tube. If the mechanical slicer fails to operate properly, some lamps can contain no mercury while other lamps receive double dosing. This technique has other disadvantages. Safety issues associated with handling mercury in the lamp fabrication environment require special equipment, including respirators. If the dispenser becomes inoperative, the exhaust tube must be shut down and the production off that unit interrupted until the entire assembly is replaced. The dispensing system also requires periodic cleaning and rebuilding since it is a mechanical system.

Other dosing systems include use of a glass mercury ampule surrounded by a ferro magnetic strip. The entire ampule assembly is attached to a fluorescent mount by a spud wire. The ampule consists of a glass envelope with a fuse wire which provides continuity with the ferro-magnetic strip. The entire mount is sealed into the lamp and the mercury is released by means of R.F. energy. The lamp is exposed to an R.F. source which couples with the ferro-magnetic strip. The current in this loop heats the fuse wire which melts the glass and breaks the hermetic seal, releasing the mercury into the lamp. This system has many disadvantages. It requires a complex cathode with extra components, including the ampule, fuse wire, ferro-magnetic strip or shield, and spud wire. These extra components increase the material cost of the lamp and add processing steps which result in greater expense.

Other systems to dose mercury include provision of strips with a mercury compound embedded on the surface of the strip. When the mercury compound is heated to a sufficient temperature, mercury is released from the surface. The means to heat the material to an activation temperature employ R.F. energy to couple with the strip. The material must be heated to high temperature, of a magnitude of 800° C., for a period of 10 to 15 seconds. This results in many problems since the other components on the finished lamp cathode cannot tolerate heating to a high temperature. These components include the two leadwire filament supports, the tungsten filament itself, and the emissive coating material, which is in an oxide form. If any of these components are heated to a high temperature, they can outgas and contaminate the lamp, which results in poor lamp performance. Since the strip material must be heated to a high temperature for a long duration, it is difficult to perform activation without damaging the other components. Another disadvantage of the strips with mercury compounds is that the strip must have a large surface area to contain enough mercury to sustain the lamp for its rated life. This results in unduly large cathode structures, which are difficult to process on lamp making equipment. The final drawback to this approach is that there is no means to determine if the strip is heated to a sufficient temperature and maintained at that temperature sufficiently to dispense or release all the mercury from the surface of the strip. If this is not the case, the mercury which was not released remains on the surface of the strip in an unusable form. This can result in failure to meet rated lamp life. Again, the strip must be mounted by a spud wire which adds to the complexity of the design. The strip system adds incremental cost which is undesirable.

Another method to dispense mercury consists of using a deep drawn tube of a suitable steel alloy, depositing the mercury into the tube with a dispensing mechanism, or injector, and crimping it together with a cold fusion weld to hermetically seal it. The capsule can be attached to the clamp area of the inner leadwire and processed on an exhaust machine. After the exhaust process, the capsule can be opened by any suitable means, including anode heating via collecting rectified current through the capsule, which causes the capsule seal to fail and the mercury to release. R.F. heating can also be employed. This system also has disadvantages. The dimensions on the cold weld seal are critical to proper operation and difficult to maintain. If the seal is too weak, the mercury may leak out early in the exhaust process and result in a low or no mercury lamp. The shape of the capsule also poses many problems. Since the part is not symmetrical, it is difficult to feed and handle on production equipment, which results in unneeded downtime and scrap. The capsule itself is also expensive to fabricate. The capsule is attached to the leadwire by welding which is difficult and can potentially damage the cathode if any material is sputtered during the welding process.

Accordingly, there is a need for an improved mercury capsule for use in fluorescent lamps, which capsule is of low cost, easy to handle, facilitates a mercury-free lamp production environment, facilitates easy measurement of precise doses, and is inexpensive to make and simple and inexpensive to use in lamp fabrication.

SUMMARY OF THE INVENTION

With the above and other objects in view, as will hereinafter appear, a mercury capsule for use in a fluorescent lamp comprises a metal ribbon which, in turn, comprises a first portion having a depression formed in a surface thereof for receiving and containing mercury, a second portion having a protrusion formed on a surface thereof, and a bendable portion interconnecting the first and second portions. The second portion is bendably movable to a position wherein the protrusion overlies the depression and is further movable to place the protrusion in sealing engagement with the depression to sealingly enclose mercury in the depression.

In accordance with a further feature of the invention there is provided a mercury capsule for use in a fluorescent lamp, the capsule comprising a metal ribbon comprising a first portion having a depression formed in a surface thereof, and a second portion having a protrusion formed on a surface thereof. The first and second portion surfaces are adjacent each other and the protrusion is sealingly engaged in the depression to define a chamber in the depression. The first and second portions are interconnected by a bent portion facilitating the adjacency of the first and second portion surfaces. A selected quantity of liquid mercury is disposed in the chamber.

In accordance with a still another feature of the invention, there is provided a fluorescent lamp having an envelope of light-transmitting vitreous material, having opposed end portions, first and second electrodes respectively disposed within the opposed end portions, and a pair of lead-in wires connected to the first and second electrodes, and containing an inert starting gas. An improvement comprises a mercury capsule secured to one of the lead-in wires. The mercury capsule comprises a metal ribbon comprising a first portion having a depression formed in a surface thereof, and a second portion having a protrusion formed on a surface thereof. The first and second portion surfaces are adjacent each other and the protrusion is sealingly engaged in the depression to define a chamber in the depression. The first and second portions are interconnected by a bent portion facilitating the adjacency of the first and second portion surfaces. A selected quantity of liquid mercury is disposed in the chamber.

In accordance with a still further feature of the invention, there is provided a method for making a mercury capsule for use in a fluorescent lamp, the method comprising the steps of providing a metal ribbon comprising a first portion having a depression formed in a surface thereof, and a second portion having a protrusion formed on a surface thereof, and a bendable portion interconnecting the first and second portions. The method further includes the steps of placing a selected amount of liquid mercury in the depression, bending the bendable portion to move the second portion to a position wherein the protrusion overlies the depression, and further bending the bendable portion to move the protrusion into sealing engagement with the depression to sealingly enclose the mercury in the depression.

The above and other features of the invention, including various novel details of construction and combinations of parts and method steps, will now be more particularly described with reference to the accompanying drawings and pointed out in the claims. It will be understood that the particular device and method steps embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings

DESCRIPTION OF THE PREFERRED EMBODIMENT

Figure 1:
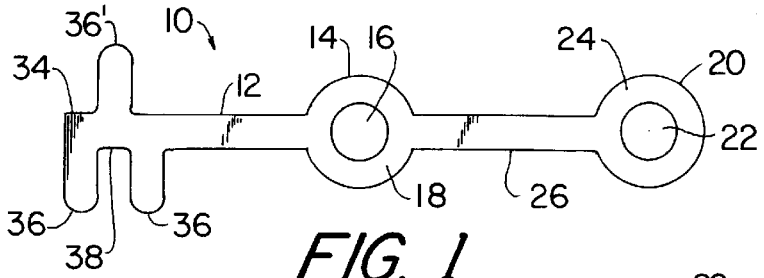
FIG. 1 is a top plan view of one form of capsule illustrative of an embodiment of the invention, the capsule shown before insertion of mercury and before being fixed in a lamp.
Figure 2:
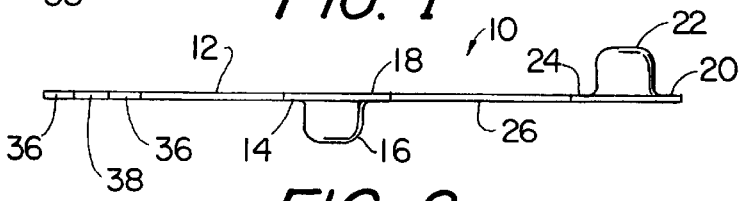
FIG. 2 is a side elevational view of the capsule of FIG. 1.

Referring to FIGS. 1 and 2, it will be seen that an illustrative capsule 10 comprises a metal ribbon 12 including a first portion 14 having a depression 16 formed in a surface 18 thereof for receiving and retaining a body of mercury. The ribbon 12 further includes a second portion 20 having a protrusion 22 formed on a surface 24 thereof. The protrusion 22 and depression 16 are of complementary configuration. The ribbon 12 still further includes a bendable portion 26 which interconnects the first and second portions 14, 20.

Figure 3:
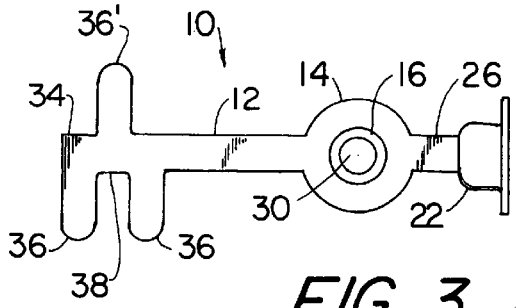
FIG. 3 is similar to FIG. 1, but shows the capsule after insertion of mercury and in the midst of a bending step in securing the mercury in the capsule.
Figure 4:
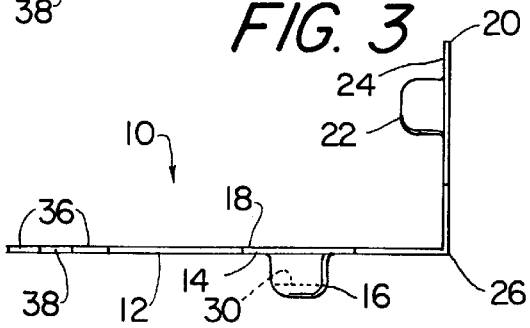
FIG. 4 is a side elevational view of the capsule of FIG. 3.

As illustrated in FIGS. 3 and 4, the portions 14, 20 are bendably movable to a position wherein the protrusion 22 overlies the depression 16, and are further movable (FIGS. 5 and 6) after a body of liquid mercury 30 has been placed in the depression 16, to place the first portion surface 18 adjacent the second portion surface 24 and to clamp the protrusion 22 into sealing engagement with the depression 16, to form an enclosed chamber 32 in which the mercury 30 is sealingly captured.

Preferably, the ribbon 12 is of stainless steel, is about 0.006–0.008 inch in thickness, and is nickel coated. The depression 16 preferably is sized to accept about 5 mg of mercury.

Figure 5:
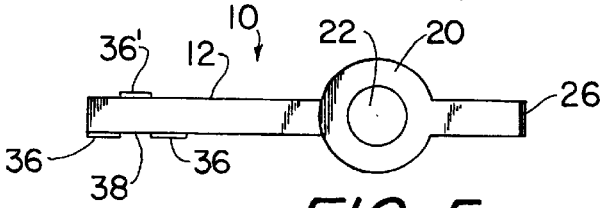
FIG. 5 is similar to FIG. 3, but shows the capsule in a sealed closed condition with mercury secured therein, and a clamp portion bent to position for mounting the capsule in a lamp.
Figure 6:
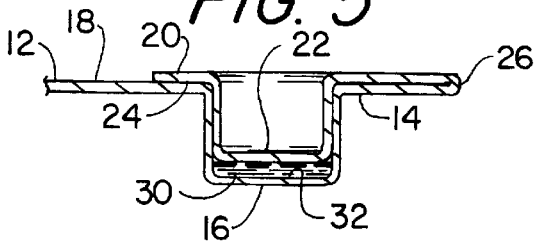
FIG. 6 is a centerline sectional view showing the capsule in the sealed closed condition with mercury secured therein, and the clamp portion bent to the position for mounting the capsule in a lamp.

The ribbon 12 preferably is provided with a clamp portion 34 defining tabs 36 which are bendable from a position co-planer with the ribbon (FIGS. 1–4) to a position generally normal thereto (FIGS. 5 and 6).

The ribbon first and second portions 14, 20, the bendable portion 26, and the clamp portion 34 preferably collectively comprise a single unitary member, which may be made in a single stamping.

Figure 7:
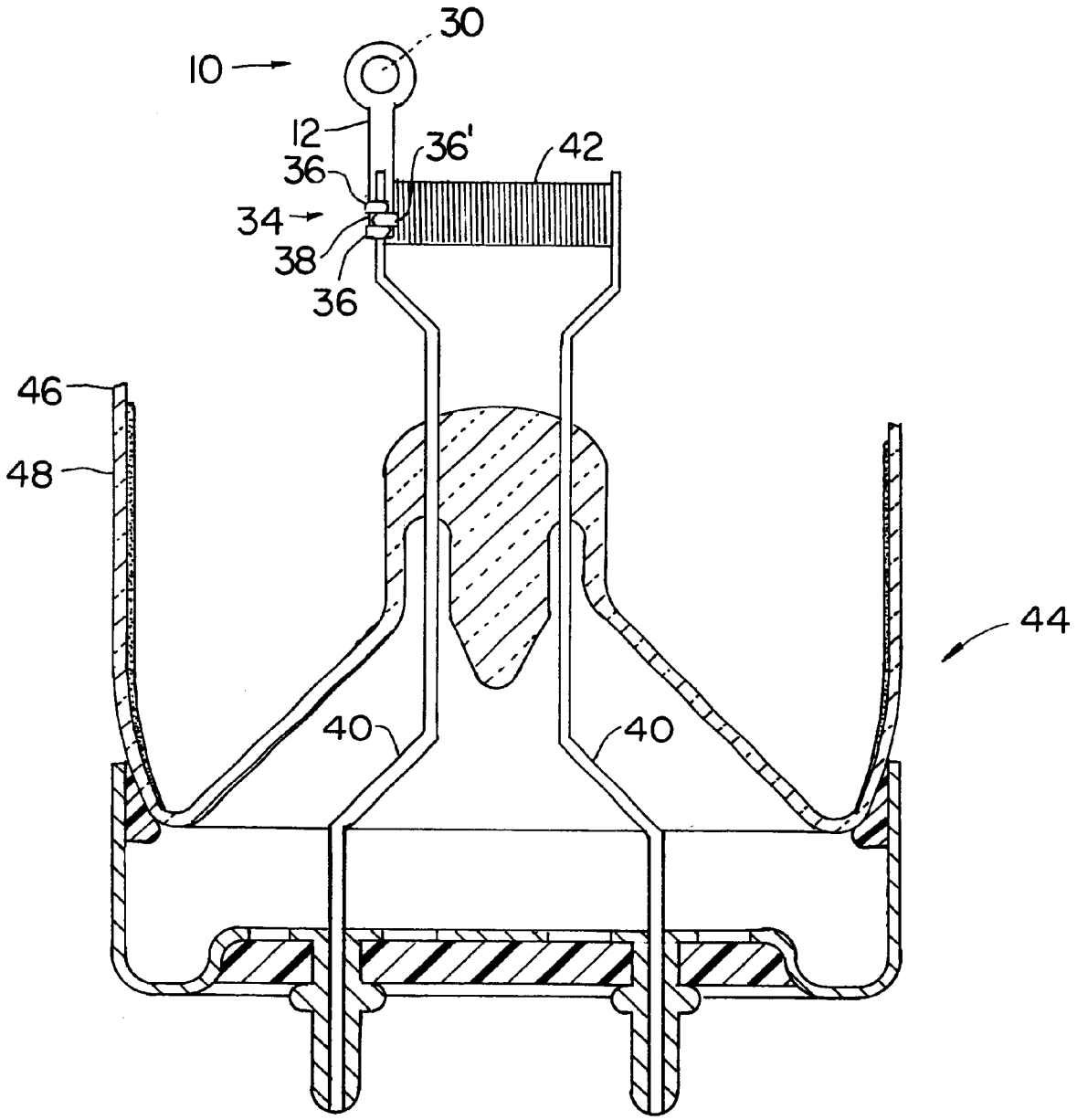
FIG. 7 is a partially sectional, partially elevational view of a lamp electrode assembly with the capsule of FIG. 5 fixed thereto.

In FIG. 7, the above described capsule 10 is shown affixed to a lead-in wire 40 for a first electrode 42 in a first end portion 44 of a fluorescent lamp 46. The tabs 36 are bent around the lead-in wire 40. As shown in FIGS. 1, 3 and 5, two of the tabs 36 are separated by a notch 38 which is of sufficient size to permit an opposed tab 36' to fit therebetween when the tabs are bent around the wire 40.

Figure 8:
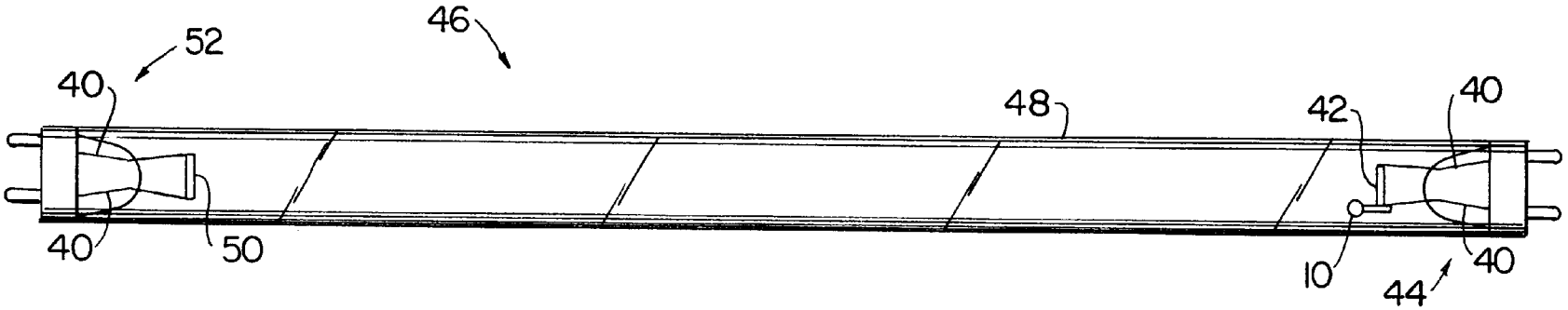
FIG. 8 is a side elevational view of a fluorescent lamp having the electrode assembly and capsule of FIG. 7 therein.

In FIG. 8, there is shown the fluorescent lamp 46 having an elongated light-transmitting envelope 48 of vitreous material and having the aforementioned first electrode 42 in the first end portion 44 thereof, and an opposed second electrode 50 in a second end portion 52 thereof. The envelope 48 contains an inert starting gas, as is well known. Each of the electrodes 42, 50 is mounted on a pair of the lead-in wires 40.

There is thus provided a capsule which is very inexpensive to manufacture. The capsule is safe to use in the lamp fabrication environment, inasmuch as the mercury is sealed in the capsule. The measurement of the appropriate amount of mercury is relatively easy, inasmuch as the chamber in the capsule is limited to a selected volume of liquid mercury. Further, no capsule supporting structure is required in the lamp inasmuch as the capsule is attachable to a lead-in wire, which is a required component of the lamp independent of mercury considerations.

It is to be understood that the present invention is by no means limited to the particular construction and method steps herein disclosed and/or shown in the drawings, but also comprises any modification or equivalent within the scope of the claims.

What is claimed is:

1. A mercury capsule for use in a fluorescent lamp, said capsule comprising a metal ribbon, said metal ribbon comprising:

a first portion having a depression formed in a surface thereof for receiving and containing mercury;

a second portion having a protrusion formed on a surface thereof; and a bendable portion interconnecting said first and second portions;

wherein said second portion is bendably movable to a position wherein said protrusion overlies said depression and is further movable to place said protrusion in sealing engagement with said depression to sealingly enclose mercury in said depression.

2. The capsule in accordance with claim 1, wherein said metal ribbon is of steel.

3. The capsule in accordance with claim 2, wherein said steel metal ribbon is about 0.006–0.008 inch thick.

4. The capsule in accordance with claim 2, wherein said steel metal ribbon is nickel coated.

5. The capsule in accordance with claim 2, wherein said steel ribbon is of nickel coated stainless steel.

6. The capsule in accordance with claim 1, wherein said metal ribbon further comprises a clamp portion for fixing said capsule to a lamp terminal.

7. The capsule in accordance with claim 6 wherein said clamp portion comprises a planar portion of said ribbon having a notch therein and a bendable tab for engagement with the lamp terminal.

8. The capsule in accordance with claim 1, wherein said depression and said protrusion are complementarily configured.

9. The capsule in accordance with claim 8, wherein said depression is of a size for containing about 5 mg of liquid mercury.

10. The capsule in accordance with claim 1, wherein said first and second portions and said bendable portion collectively comprise a single unitary member.

11. The capsule in accordance with claim 6 wherein said first and second portions, said bendable portion, and said clamp portion collectively comprise a single unitary member.

12. A mercury capsule for use in a fluorescent lamp, said capsule comprising:

a metal ribbon comprising:

a first portion having a depression formed in a surface thereof;

a second portion having a protrusion formed on a surface thereof;

said first and second portion surfaces being adjacent each other and said protrusion being sealingly engaged in said depression to define a chamber in said depression;

said first and second portions being interconnected by a bent portion facilitating the adjacency of said first and second portion surfaces; and a selected quantity of liquid mercury disposed in said chamber.

13. The capsule in accordance with claim 12, wherein said selected quantity of mercury is no more than about 5 mg.

14. The capsule in accordance with claim 12, wherein said metal ribbon is of stainless steel and is nickel coated.

15. The capsule in accordance with claim 12, wherein said metal ribbon further comprises a clamp portion for fixing said capsule to a lamp terminal.

16. The capsule in accordance with claim 15, wherein said first and second portions, said bent portion, and said clamp portion collectively comprise a single unitary member.

17. In a fluorescent lamp having an envelope of light-transmitting vitreous material, having opposed end portions, first and second electrodes respectively disposed within said opposed end portions, a pair of lead-in wires connected to said first and second electrodes, and containing an inert starting gas, an improvement comprising a mercury capsule secured to one of said lead-in wires, said mercury capsule comprising:

a metal ribbon comprising:

a first portion having a depression formed in a surface thereof;

a second portion having a protrusion formed on a surface thereof;

said first and second portion surfaces being adjacent each other and said protrusion being sealingly engaged in said depression to define a chamber in said depression;

said first and second portions being interconnected by a bent portion facilitating the adjacency of said first and second portion surfaces; and a selected quantity of liquid mercury disposed in said chamber.

18. The fluorescent lamp in accordance with claim 17 wherein said metal ribbon is of nickel coated stainless steel and is about 0.006–0.008 inch thick.

19. A method for making a mercury capsule for use in a fluorescent lamp, the method comprising the steps of:

providing a metal ribbon comprising:

a first portion having a depression formed in a surface thereof;

a second portion having a protrusion formed on a surface thereof; and a bendable portion interconnecting the first and second portions;

placing a selected amount of liquid mercury in the depression;

bending the bendable portion to move the second portion to a position wherein the protrusion overlies the depression; and further bending the bendable portion to move the protrusion into sealing engagement with the depression to sealingly enclose the mercury in the depression.

20. The method in accordance with claim 17, wherein the metal ribbon further comprises a clamp portion, and the method further includes the step of fastening the capsule to a lamp terminal by manipulation of the clamp portion.

* * * * *